United States Patent [19]

Kershaw

[11] Patent Number: 4,706,954

[45] Date of Patent: Nov. 17, 1987

[54] BASKETBALL RETURN DEVICE

[76] Inventor: Thomas R. Kershaw, 2086 Carter Rd., Geneva, N.Y. 14456

[21] Appl. No.: 901,121

[22] Filed: Aug. 28, 1986

[51] Int. Cl.[4] ..... A63B 69/00

[52] U.S. Cl. ..... 273/1.5 A

[58] Field of Search ..... 273/1.5 R, 1.5 A, 395, 273/396; D21/201

[56] References Cited

U.S. PATENT DOCUMENTS

| | | | |
|---|---|---|---|
| D. 260,669 | 9/1981 | Armstrong | D21/201 |
| D. 260,670 | 9/1981 | Armstrong | D21/201 |
| 2,808,264 | 10/1957 | Scalf | 273/1.5 A |
| 3,799,543 | 3/1974 | Steele, Jr. | 273/1.5 A |
| 3,814,421 | 6/1974 | Spier, Jr. | 273/1.5 A |
| 3,945,638 | 3/1976 | Luebkeman | 273/1.5 A |
| 4,579,339 | 4/1986 | Grimm | 273/1.5 A |

*Primary Examiner*—Paul E. Shapiro

*Attorney, Agent, or Firm*—Stonebraker, Shepard & Stephens

[57] ABSTRACT

A basketball return device 20 is formed as a resilient deflector having an upper wing 30 positioned behind a basketball net 15 and a lower wing 35 positioned below the bottom of basketball net 15, device 20 being hooked onto the rim 11 and braced under a bracket 12 that supports the rim on a backboard 13. A pair of resilient loops 22 extend between a brace 25 engaging the underside of bracket 12 and hooks 21 that are spaced apart to hook over rim 11 on opposite sides of the bracket. The device can be formed of resilient resin material to be deformed by engagement with a basketball and to spring back to direct the basketball back toward its shooter.

34 Claims, 6 Drawing Figures

BASKETBALL RETURN DEVICE

BACKGROUND

Several innovators have suggested devices for returning to the shooter a basketball shot successfully into a basketball basket. Several variations on ball return chutes disposed below the basketball rim have been suggested in U.S. Pat. Nos. 2,808,264; 3,814,421; 3,945,638; and 4,579,339; and Steele's U.S. Pat. No. 3,799,543 suggests a resilient ball deflector disposed behind the net and magnetically attached to the underside of the rim. So far as applicant can determine, none of these devices are presently available in the marketplace; and all of them involve substantial problems, such as complexity, expense, installation costs, disablement of the basket while installed, and inability to return successive basketballs toward different directions from which they were shot.

My basketball return device overcomes these problems with a simple and inexpensive device that can attach quickly and easily to most basketball baskets where it effectively returns balls to shooters throughout a reasonably wide center court shooting arc. My device is also rugged, durable, safe, and easy to use for basketball shooting practice.

SUMMARY OF THE INVENTION

My basketball return device is formed as a flexible element having a pair of rim hooks, a bracket brace, and a ball deflector. The rim hooks are spaced apart and hook over a basketball rim on opposite sides of a bracket supporting the basketball rim on a backboard. A pair of flexible loops extend downward from the hooks and up to the brace, which is spaced from the rim to engage the underside of the bracket. The ball deflector extends downward from the brace to an upper wing curved around the backside of a net hanging on the rim and further downward to a lower wing disposed underneath a bottom opening of the net. The way that the upper region of my device is resiliently braced and connected to the basket disposes the upper and lower wings flexibly behind and beneath the net where they are shaped for resiliently returning basketballs back toward their shooters.

DRAWINGS

DETAILED DESCRIPTION

Figure 1:
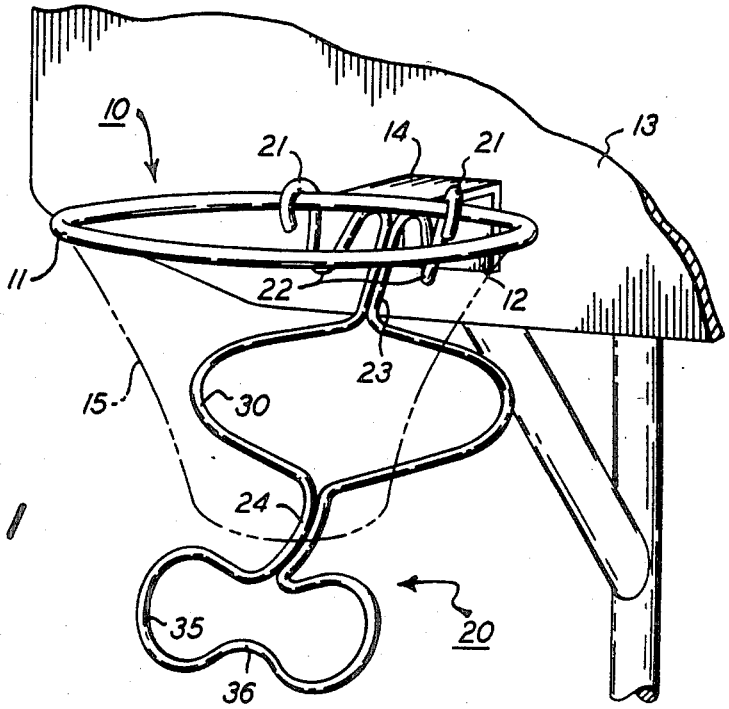
FIG. 1 is a perspective view of a preferred embodiment of my device mounted on a basketball basket.

My ball return device 20, as shown in the drawings, fits most basketball baskets 10. These all include a rim 11 and a bracket 12 supporting rim 11 from a backboard 13. Brackets 12 exist in many shapes and configurations, but most of them include a plate 14 extending horizontally across the space between rim 11 and backboard 13. My device 20 takes advantage of this by using a brace 25 disposed to engage the underside of bracket plate 14 and using a pair of rim hooks 21 spaced apart on opposite sides of bracket plate 14. A pair of resilient loops 22 extend downward from hooks 21 and up to brace 25, and the separate hooks 21 and loops 22 preferably join together in a region 23 just below brace 25. Resilient loops 22 also allow hooks 21 to be spread apart or moved together if necessary to clear the structure of bracket 12.

The resilient bracing provided by loops 22 between hooks 21 and brace 25 disposes an upper wing 30 and a lower wing 35 respectively behind and beneath a net 15 hanging on rim 11. Upper wing 30 curves behind net 15 in a pair of horizontally extending lobes forming a generally oval shape with an open center. The open space within upper wing 30 is less than the spherical diameter of a basketball, so that a basketball cannot fit through wing 30. Lower wing 35 is also formed in an open loop in a generally oval shape and is also curved laterally as disposed beneath net 15. Lower wing 35 has an inturned region 36 narrowing the central space within lower wing 35 and preventing a basketball from nesting in lower wing 35. The lateral spaces between upper wing 30 and lower wing 35 are also less than nine inches across so that a basketball cannot pass through between the lateral edges of the upper and lower wings.

Figure 2:
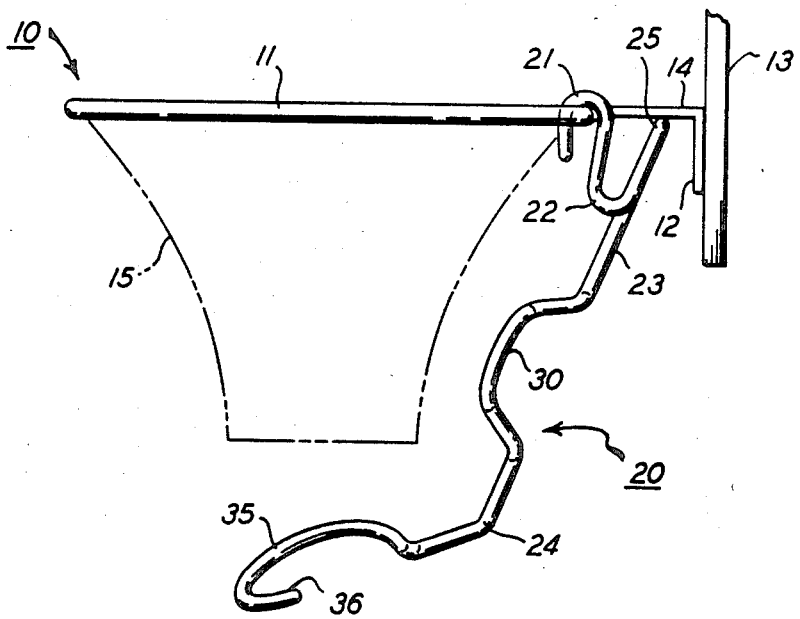
FIG. 2 is a side elevational view of the device of FIG. 1 as mounted on a basket.
Figure 3:
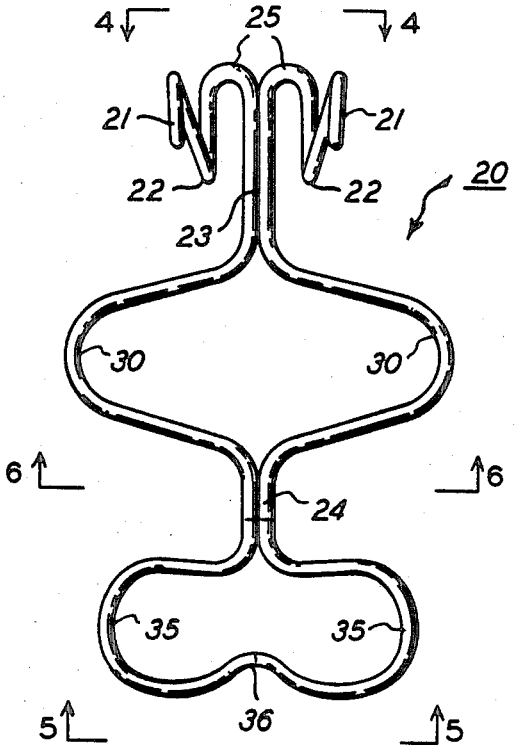
FIG. 3 is a plan view of the device of FIGS. 1 and 2.
Figure 4:
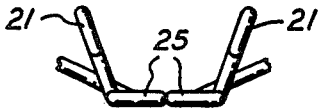
FIG. 4 is an elevational view of an upper region of the device of FIG. 3.
Figure 5:
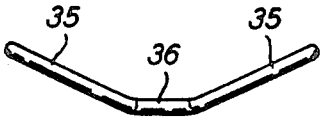
FIG. 5 is a bottom elevational view of a lower region of the device of FIG. 3.
Figure 6:
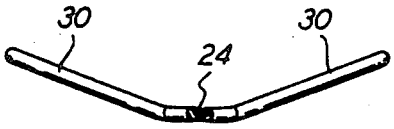
FIG. 6 is a cross-sectional view of a mid-region of the device of FIG. 3.

As illustrated in the drawings, return device 20 can be formed of a long length of resilient resin rod, ends of which are formed into hooks 21, and a central region of which is formed as return loop 36 in lower wing 35. A rod forming device 20 is preferably joined to itself in region 23 below brace 25 and in region 24 between the upper and lower wings. Region 24 is angled as best shown in FIG. 2 to dispose lower wing 35 beneath the bottom of net 15 while upper wing 30 curves behind net 15. Device 20 can also be injection molded of an integral piece of resin material and can be formed of steel or other resilient materials besides resin.

For shooting practice, device 20 is placed on a basketball basket by hooking hooks 21 over rim 11 astraddle bracket 12 while holding lower wing 35 forward under rim 11. Hooks 21 are preferably closed enough so that they snap over rim 11 and do not come unhooked while device 20 flexes and moves. When released, device 20 swings downward and rearward below rim 11 until brace 25 engages the underside of bracket plate 14. In this position, as shown in FIG. 2, upper wing 30 is resiliently disposed behind net 15, and lower wing 35 is resiliently disposed under the open bottom of net 15. Device 20 is free to pivot forward under net 15 and rim 11, moving brace 25 away from bracket plate 14; and this happens as device 20 rebounds from basketball impact. To remove device 20 from the basket for game play, it is only necessary to raise lower wing 35 forward and upward and then rearwardly unsnap hooks 21 from their fit over rim 11.

As resiliently disposed behind and under net 15, upper wing 30 and lower wing 35 deflect basketballs passing downward through rim 11 back in the general center court direction from which they were shot. Side court shots are generally returned to the same side region of center court. Upper wing 30 is engaged by basketballs that pass directly through rim 30 without touching. These shots drive net 15 and upper wing 30 rearwardly; and as upper wing 30 springs back from such deflection, it urges the ball forward through the bottom of net 15 back toward the shooter. The lateral curvature of upper wing 30 directs the basketball back toward the general direction from which it was shot, within a center court arc of about 45° on each side of a center line. The direction and speed of the returned ball vary considerably, depending on how the ball entered rim 11 and net 15. Shots that hit rim 11 and move more slowly through the bottom of net 15 engage and deflect lower wing 35, which springs back to bounce such balls toward the shooter. The lateral curvature of lower wing 35 helps deflect balls back in the direction from which they were shot, and the narrow central region 36 of lower wing 35 prevents any ball from resting or settling in lower wing 35 without spilling out and bouncing back to the shooter.

I claim:

1. A basketball return device comprising:

a. a flexible resin element having a pair of rim hooks, a bracket brace, and a ball deflector;

b. said rim hooks being spaced apart for hooking over a basketball rim on opposite sides of a bracket supporting said basketball rim on a backboard;

c. a pair of flexible loops extending downward from said hooks and up to said brace spaced from said rim to engage the underside of said bracket;

d. said ball deflector extending downward from said brace to an upper wing curved around the backside of a net hanging on said rim; and e. said ball deflector extending downward from said upper wing to a lower wing disposed underneath a bottom opening of said net, said upper and lower wings being flexibly disposed to be engaged by basketballs passing through said rim for resiliently returning said basketballs back toward their shooters.

2. The device of claim 1 wherein said upper and lower wings are formed of open loops.

3. The device of claim 2 wherein said lower wing has a narrow central region between wider side regions so that a basketball cannot rest in said lower wing.

4. The device of claim 2 wherein spaces between and within said upper and lower wings are less than the diameter of a basketball.

5. The device of claim 1 wherein said flexible resin element has a peripheral contour forming said rim hooks and said brace and extending around loops forming said upper and lower wings.

6. The device of claim 5 wherein said flexible resin element is formed of a length of resin rod joined to itself in the region of said brace and in a region between said upper and lower wings.

7. The device of claim 1 wherein said device is free to pivot forward on said rim hooks away from said bracket.

8. A device for returning toward the shooter a basketball that is shot to pass down through a basketball rim and through a net hung from said rim, said device comprising a flexible element formed of a single piece of resin material, said element having:

a. a pair of hooks spaced-apart to hook over said rim on opposite sides of a bracket supporting said rim from a backboard;

b. a brace spaced from said rim to engage an underside of said bracket;

c. an upper wing disposed below said brace and curving around the backside of said net; and d. a lower wing disposed below said upper wing and underneath an opening at the bottom of said net.

9. The element of claim 8 including a pair of loops extending downward from said hooks and upward to said brace.

10. The element of claim 8 wherein said upper and lower wings are formed of open loops.

11. The element of claim 10 wherein said lower wing is laterally curved and has a narrow central region preventing a basketball from resting in said lower wing.

12. The element of claim 8 wherein said upper and lower wings are formed as open loops and the spaces between and within said upper and lower wings are less than the diameter of a basketball.

13. The element of claim 8 wherein said element is formed of a single rod of resin material contoured to form said hooks, said brace, and said upper and lower wings as open loops.

14. The element of claim 13 wherein said rod is welded to itself in a region between said upper and lower wings and in the region of said brace.

15. The element of claim 8 wherein said device can pivot on an axis through said hooks and said rim to move said brace away from said bracket and swing said device under said rim.

16. A basketball return device comprising: a flexible resin element contoured to extend around a lower loop disposed underneath a net hanging from a basketball rim, upward along the backside of said net to an upper loop curved around the backside of said net, upward from said upper loop to a brace engaging the underside of a bracket supporting said rim on a backboard, downward from said brace, and forward in a pair of U-shaped loops rising to a pair of hooks that hook over said rim on opposite sides of said bracket.

17. The device of claim 16 wherein said lower loop is laterally curved and has a narrow central region preventing a basketball from resting in said lower loop.

18. The device of claim 16 wherein said device is free to pivot forward on said hooks underneath said rim and clear of said bracket.

19. The device of claim 16 wherein said element is formed of a flexible resin rod joined to itself between said upper and lower loops and in the region of said brace.

20. The device of claim 16 wherein space within and between said upper and lower loops is less than the diameter of a basketball.

21. In a basketball return device having a flexible element disposed behind and below a basketball net, the improvement comprising:

a. said flexible element having a pair of hooks spaced apart for hooking over a rim for said net on opposite sides of a bracket supporting said rim on a backboard;

b. a brace spaced from and centered between said hooks for engaging an underside of said bracket; and c. a pair of resilient and U-shaped loops extending between said hooks and said brace so that said resilient loops contribute to the resilience of said element in the region behind and beneath said net.

22. The improvement of claim 21 wherein elements forming said U-shaped loops are joined together in the region of said brace.

23. The improvement of claim 21 wherein said hooks, loops, and brace are formed of a resilient resin rod.

24. The improvement of claim 23 wherein said rod is joined to itself in the region of said brace.

25. The improvement of claim 21 wherein said flexible element in said region behind and beneath said net is contoured to form an upper and a lower wing.

26. The improvement of claim 25 wherein said upper wing curves laterally behind said net.

27. The improvement of claim 26 wherein said lower wing curves laterally and has a narrow central region so that a basketball cannot rest in said lower wing.

28. The improvement of claim 21 wherein said device can pivot on said hooks forward from said bracket.

29. A basketball return device comprising:

a. an element extending resiliently downward behind a basketball net to a lower wing resiliently disposed beneath an open bottom of said net;

b. said element having resilient hooks spaced apart for hooking over said rim on opposite sides of a bracket supporting said rim on a backboard;

c. said element having a brace spaced from said hooks to engage an underside of said bracket; and d. U-shaped arms extending between said hooks and said brace.

30. The device of claim 29 wherein in hooks are free to pivot on said rim so that said element can move forward away from said bracket and under said rim.

31. The device of claim 29 wherein said arms are joined to each other in the region of said brace.

32. The device of claim 29 including an upper wing spaced between said brace and said lower wing, said upper wing curving around a backside of said net.

33. The device of claim 32 wherein said upper and lower wings are formed as open loops and space within and between said upper and lower wings is less than the diameter of a basketball.

34. The device of claim 29 wherein said lower wing is laterally curved and has a narrow central region so that a basketball cannot nest in said lower wing.

* * * * *